US005267522A

United States Patent [19]

Skaarup et al.

[11] Patent Number: 5,267,522

[45] Date of Patent: Dec. 7, 1993

[54] STRIPPING GUTTER FOR LIQUID CARGO VESSELS

[75] Inventors: Ole Skaarup, Greenwich; James H. Hara, Ridgefield, both of Conn.

[73] Assignee: Skarhar, Inc., Greenwich, Conn.

[21] Appl. No.: 974,066

[22] Filed: Nov. 10, 1992

[51] Int. Cl.[5] ..... B63B 25/12

[52] U.S. Cl. ..... 114/74 R; 222/564

[58] Field of Search ..... 114/72, 73, 74 R, 74 A, 114/74 T; 137/590, 574; 414/142.2, 142.3; 141/391; 222/564

[56] References Cited

U.S. PATENT DOCUMENTS 3,766,875 10/1973 Baki ..... 114/74 R

FOREIGN PATENT DOCUMENTS 0083291 7/1978 Japan ..... 114/74 R 0456691 2/1992 Japan ..... 114/74 R

*Primary Examiner*—Edwin L. Swinehart

*Attorney, Agent, or Firm*—John H. Crozier

[57] ABSTRACT

In a preferred embodiment, a stripping gutter for a liquid cargo vessel having therein a liquid carrying tank defined between the bottom of the vessel, forward and aft bulkheads, and the starboard and port sides of the hull of the vessel, with a sump disposed in the bottom on the centerline of the vessel at the aft bulkhead of the tank, the stripping gutter including: first and second, inclined, generally triangular plates; the first plate being attached to the inner surfaces of the aft bulkhead, the starboard side, and the bottom, such that the first plate slopes forwardly from top to bottom and forwardly from an inner apex at the sump to an outer edge at the starboard side; and the second plate being attached to the inner surfaces of the aft bulkhead, the port side, and the bottom, such that the second plate slopes forwardly from top to bottom and forwardly from an inner apex at the sump to an outer edge at the starboard side; whereby, when the vessel trims by the stern as the vessel is unloaded, residual liquid in the tank will flow aftwardly to the stripping gutter defined between the first and second plates and the bottom and then along the stripping gutter to the sump.

5 Claims, 2 Drawing Sheets

STRIPPING GUTTER FOR LIQUID CARGO VESSELS

BACKGROUND OF THE INVENTION

1. Field of the Invention

The present invention relates to liquid cargo vessels generally and, more particularly, but not by way of limitation, to a novel stripping gutter which consumes less volume than conventional structures.

2. Background Art

Liquid cargo vessels have been used for years for transporting liquids such as petroleum and the products thereof. Such vessels typically have one or more generally rectangular tanks in which the liquid is carried. When unloading the liquid, provision must be made to assure that as much liquid as possible is removed from each tank, so that valuable product is not lost and to minimize the potential creation of pollution when the tanks are cleaned.

Conventionally, plates are inserted in each tank and along the length thereof to form a V-shaped bottom in each tank with the apex of the V on the centerline of the vessel. A sump with a deep well pump is installed at the aftermost part of the V. As the vessel trims by the stern when the vessel is unloaded, residual liquid flows downwards toward the V and aftwards toward the sump. Thus, essentially all the liquid is removed from the tanks.

A disadvantage with this conventional construction is that the volume defined between the plates and the hull of the vessel is relatively large and represents a reduction in liquid carrying capacity of the vessel.

Accordingly, it is a principal object of the present invention to provide a structure for the removal of residual liquid from a tank of a vessel which structure consumes a minimal volume of the tank.

It is a further object of the invention to provide such a structure that is economically and easily constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a stripping gutter for a liquid cargo vessel having therein a liquid carrying tank defined between the bottom of said vessel, forward and aft bulkheads, and the starboard and port sides of the hull of said vessel, with a sump disposed in said bottom on the centerline of said vessel at said aft bulkhead of said tank, said stripping gutter comprising: first and second, inclined, generally triangular plates; said first plate being attached to the inner surfaces of said aft bulkhead, said starboard side, and said bottom, such that said first plate slopes forwardly from top to bottom and forwardly from an inner apex at said sump to an outer edge at said starboard side; and said second plate being attached to the inner surfaces of said aft bulkhead, said port side, and said bottom, such that said second plate slopes forwardly from top to bottom and forwardly from an inner apex at said sump to an outer edge at said starboard side; whereby, when said vessel trims by the stern as said vessel is unloaded, residual liquid in said tank will flow aftwardly to said stripping gutter defined between said first and second plates and said bottom and then along said stripping gutter to said sump.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
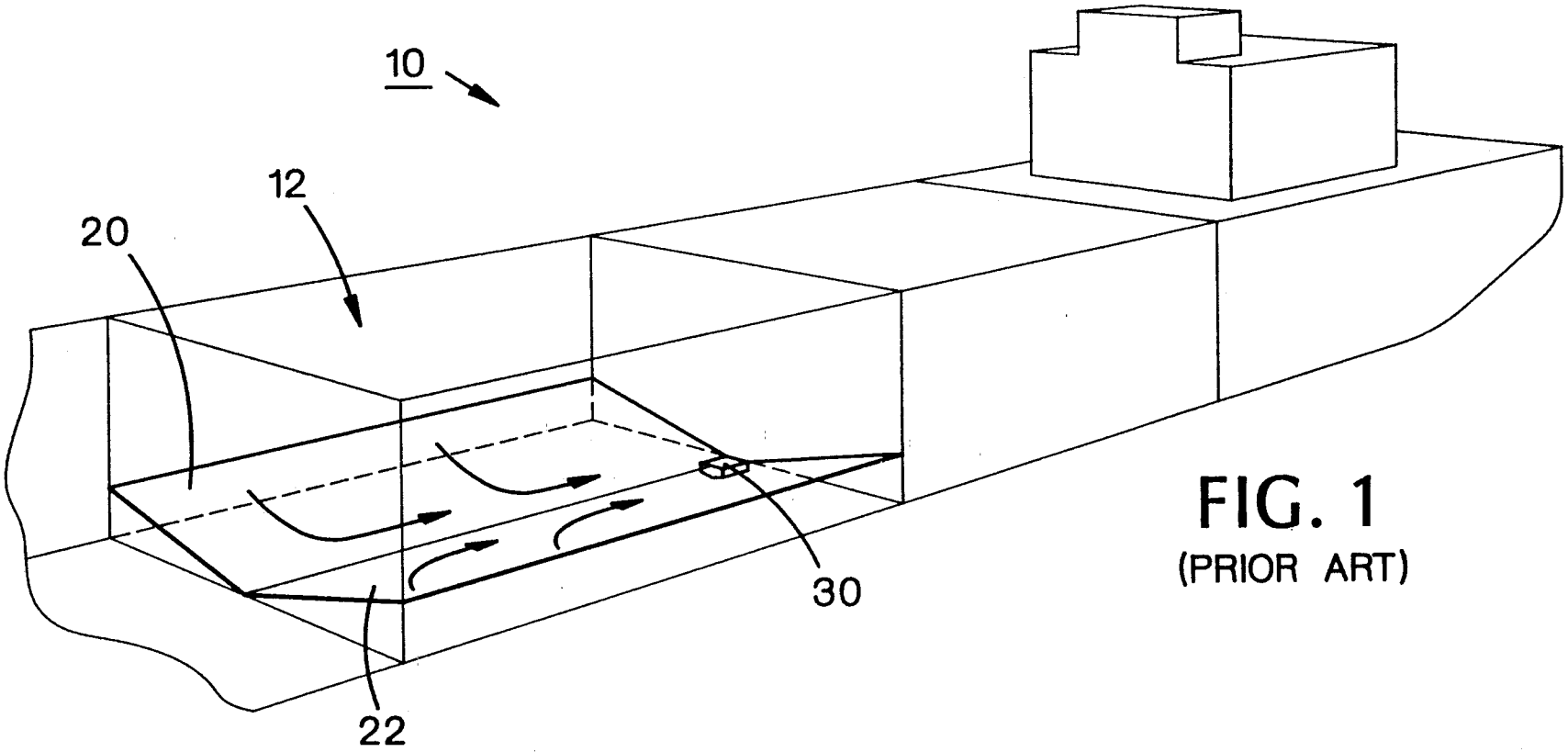
FIG. 1 (PRIOR ART)
FIG. 1 is a perspective view of a conventional structure for removing residual liquids from the tanks of vessels.

Referring now to the drawing figures, FIG. 1 illustrates a liquid cargo vessel, generally indicated by the reference numeral 10. A conventional structure for removing residual liquid from the vessel is shown for one tank 12 of vessel 10 and includes first and second inclined plates 20 and 22 which run the length of the tank. The outer and upper horizontal edges of plates 20 and 22 are welded, respectively, to the inner surfaces of the starboard and port sides of the hull of vessel 10, while the inner edges of the plates meet along the centerline of the vessel to form a V-shape. A sump 30 with a deep well pump therein (not shown) is disposed at the aftermost portion of the V-shape.

As is described above, when vessel 10 is unloaded, it will trim by the stern and residual liquid in tank 12 will flow downwards and aftwards to sump 30, as is indicated by the arrows, and be pumped from the vessel. Thus, substantially all the liquid is removed from tank 12. However, it can be seen that the volume defined between the plates and the sides and bottom of the hull is relatively large and represent reduced cargo carrying capacity of vessel 10.

Figure 2:
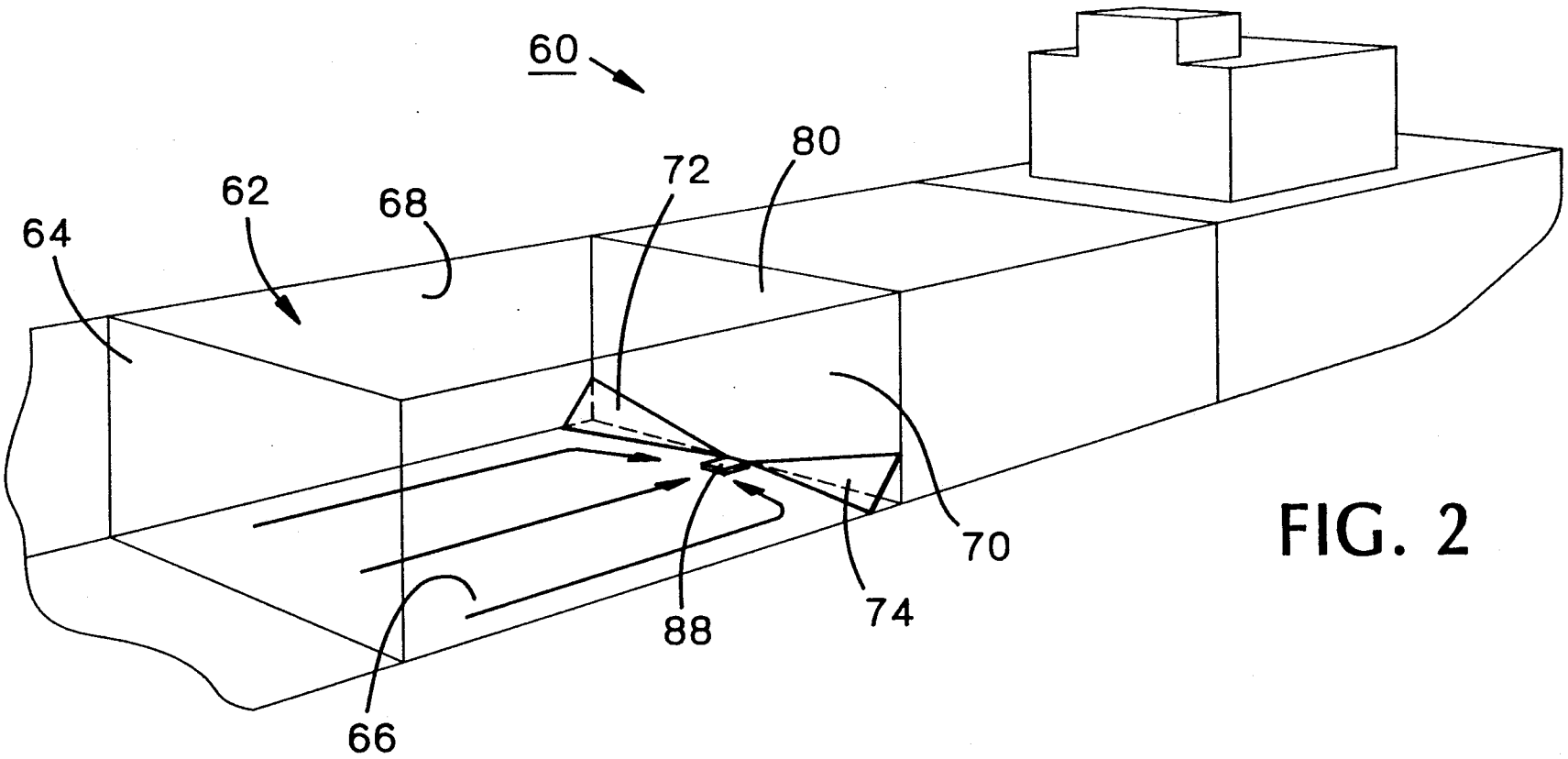
FIG. 2 is a perspective view of a structure for removing residual liquids from the tanks of vessels, according to the present invention.

FIG. 2 illustrates a vessel, generally indicated by the reference numeral 60, incorporating the present invention installed in a tank 62 of the vessel, the tank being defined between a forward bulkhead 64, the bottom 66 of the hull of the vessel, and starboard and port sides 68 and 70, respectively, of the hull, and an aft bulkhead 80. With the invention, the conventional V-shape is eliminated and replaced with a stripping gutter formed by inclined, generally triangular shaped plates 72 and 74. Plate 72 is attached to the inside surfaces of aft bulkhead 80, bottom 66, and starboard side 68. Plate 74 is attached to the inside surfaces of aft bulkhead 80, bottom 66, and port side 70. One apex of each of plates 72 and 74 meets the side of a sump 88 in which there is disposed a deep well pump (not shown). Thus, plates 72 and 74 each slope forwardly from top to bottom and forwardly from inner apex to outer edge.

With plates 72 and 74 so arranged, when vessel 60 trims by the stern while being unloaded, residual liquid in tank 62 will flow aftwardly to the stripping gutter and then inwardly to sump 88. Thus, while no more liquid may be removed from tank 62 compared with liquid removal from tank 12 (FIG. 1), the volume consumed by the structure of the present invention is substantially less than the volume consumed by the conventional structure. The reduced volume consumed represents additional liquid cargo that can be carried.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A stripping gutter for a liquid cargo vessel having therein a liquid carrying tank defined between the bottom of said vessel, forward and aft bulkheads, and the starboard and port sides of the hull of said vessel, with a sump disposed in said bottom at said aft bulkhead of said tank, said stripping gutter comprising: baffle means disposed between said bottom and said aft bulkhead to direct residual liquid to said sump when said vessel trims by the stern and said liquid carrying tank is unloaded, said baffle means comprising at least one plate attached to said bottom and said aft bulkhead, said plate sloping forwardly from top to bottom.

2. A stripping gutter for a liquid cargo vessel having therein a liquid carrying tank defined between the bottom of said vessel, forward and aft bulkheads, and the starboard and port sides of the hull of said vessel, with a sump disposed on the centerline of said vessel in said bottom at said aft bulkhead of said tank, said stripping gutter comprising: baffle mans disposed between said bottom and said aft bulkhead to direct residual liquid to said sump when said vessel trims by the stern and said liquid carrying tank is unloaded, said baffle means having:

(a) first and second, inclined, generally triangular plates;

(b) said first plate being attached to the inner surfaces of said aft bulkhead, said starboard side, and said bottom, such that said first plate slopes forwardly from top to bottom and forwardly from an inner apex at said sump to an outer edge at said starboard side; and (c) said second plate being attached to the inner surfaces of said aft bulkhead, said port side, and said bottom, such that said second plate slopes forwardly from top to bottom and forwardly from an inner apex at asid sump to an outer edge at said port side;

whereby, when said vessel trims by the stern as said vessel is unloaded, residual liquid in said tank will flow aftwardly to said stripping gutter defined between said first and second plates and said bottom and then along said stripping gutter to said sump.

3. A stripping gutter for a liquid cargo vessel having therein a liquid carrying tank defined between the bottom of said vessel, forward and aft bulkheads, and the starboard and port sides of the hull of said vessel, with a sump disposed in said bottom at said aft bulkhead of asid tank, asid bottom being flat and being substantially horizontal when said vessel is normally trimmed, said stripping gutter comprising: baffle means disposed between said bottom and said aft bulkhead to direct residual liquid to said sump when said vessel trims by the stern and said liquid carrying tank is unloaded.

4. A stripping gutter, as defined in claim 3, wherein said baffle means comprises at least one plate attached to said bottom and said aft bulkhead, said plate sloping forwardly from top to bottom.

5. A stripping gutter, as defined in claim 3, wherein said sump is disposed on the centerline of said vessel and said baffle means comprises:

(a) first and second, inclined, generally triangular plates;

(b) asid first plate being attached to the inner surfaces of said aft bulkhead, said starboard side, and said bottom, such that said first plate slopes forwardly from top to bottom and forwardly from an inner apex at said sump to an outer edge at said starboard side; and (c) said second plate being attached to the inner surfaces of said aft bulkhead, said port side, and said bottom, such that said second plate slopes forwardly from top to bottom and forwardly from an inner apex at said sump to an outer edge at said port side;

whereby, when said vessel trims by the stern as said vessel is unloaded, residual liquid in asid tank will flow aftwardly to said stripping gutter defined between said first and second plates and asid bottom and then along said stripping gutter to said sump.

* * * * *

UNITED STATES PATENT AND TRADEMARK OFFICE

CERTIFICATE OF CORRECTION

PATENT NO. : 5,267,522

DATED : December 7, 1993

INVENTOR(S) : Ole Skaarup, et al

It is certified that error appears in the above-indentified patent and that said Letters Patent is hereby corrected as shown below:

Column 4, lines 31, 44, and 46, "asid" should read --said--.

Signed and Sealed this

Twenty-sixth Day of April, 1994

Bruce Lehman

*Attest:*

BRUCE LEHMAN

*Attesting Officer*

*Commissioner of Patents and Trademarks*